US006726032B2

(12) United States Patent
Sullivan

(10) Patent No.: US 6,726,032 B2
(45) Date of Patent: Apr. 27, 2004

(54) FLIP TOP MAGAZINE CART

(75) Inventor: Sean Sullivan, Richmond Hill (CA)

(73) Assignee: Navillus Innovations Inc., Richmond (CA); .

( * ) Notice: Subject to any disclaimer, the term of this patent is extended or adjusted under 35 U.S.C. 154(b) by 0 days.

(21) Appl. No.: 10/103,146

(22) Filed: Mar. 22, 2002

(65) Prior Publication Data

US 2002/0148793 A1 Oct. 17, 2002

(30) Foreign Application Priority Data

Mar. 22, 2001 (CA) ..... 2341789

(51) Int. Cl.[7] ..... B42F 7/00
(52) U.S. Cl. ..... 211/50
(58) Field of Search ..... 211/50, 133.1, 211/49.1, 45, 42, 85.8, 126.1

(56) References Cited

U.S. PATENT DOCUMENTS 4,890,748 A * 1/1990 Visser ..... 211/133.1
5,722,628 A * 3/1998 Menaged ..... 248/441.1
6,467,780 B1 * 10/2002 Winslow ..... 280/47.35

* cited by examiner

*Primary Examiner*—Alvin Chin-Shue
*Assistant Examiner*—Sarah Purol
(74) *Attorney, Agent, or Firm*—Richard C. Litman

(57) ABSTRACT

An improved cart for storing and displaying items is disclosed. The cart comprises a housing having a bottom, a front portion extending upward from the bottom, a back portion extending upward from the bottom portion, and opposite first and second side portions each extending upwardly from the bottom between the front and back portion to form a container configured to store objects, said container having an open top through which said objects may be deposited or retrieved. The cart has a lid dimensioned to substantially cover the open top of the container, the lid having a top edge, a bottom edge and opposite first and second side edges extending between the top and bottom edges. The lid also has a first half of a tongue in groove connector positioned on each side edge adjacent the bottom edge. The first and second side portions of the housing each have a second half of the tongue in groove connector, the second halves of the tongue in groove connector positioned on the side portions adjacent to the front portion of the housing, said first and second halves of the tongue in groove connector adapted and configured to slidingly attach the lid to the first and second side portions of the housing. The lid is slidingly movable between a closed position wherein the lid lies inclined over the open top with a portion of the lid adjacent the top edge resting on top of the back portion of the housing, and an open position wherein the lid is positioned away from the open top and adjacent the front portion of the housing.

3 Claims, 3 Drawing Sheets

FLIP TOP MAGAZINE CART

FIELD OF THE INVENTION

The invention relates generally to carts for storing magazines.

BACKGROUND OF THE INVENTION

Magazine racks are a common household item. Usually a magazine rack consists of a housing or container which is adapted to receive a plurality of magazines of different sizes. These magazines may have shelving units or internal supports to permit the magazines to be stacked in a substantially vertical orientation. Several magazine racks have been available with castor wheels which extends the racks versatility by permitting it to be rolled from one room to another.

While magazine racks do permit magazines to be stored in a contained location, existing magazine storage devices do not permit a convenient method by which the magazines can be read. Essentially, the user has to remove the magazine and then find some flat surface such as a desk or chair to rest the magazine so that it may read. A magazine storage device which provides a convenient reading surface would be of value.

SUMMARY OF THE INVENTION

In accordance with present invention, there is provided an improved cart for storing and displaying items. The cart comprises a housing having a bottom, a front portion extending upward from the bottom, a back portion extending upward from the bottom portion, and opposite first and second side portions each extending upwardly from the bottom between the front and back portions to from a container configured to store objects, said container having an open top through which said objects may be deposited or retrieved. The cart has a lid dimensioned to substantially cover the open top of the container, the lid having a top edge, a bottom edge and opposite first and second aide edges extending between the top and bottom edges. The lid also has a first half of a tongue in groove connector positioned on each side edge adjacent the bottom edge. The first and second side portions of the housing each have a second half of the tongue in groove connector, the second halves of the tongue in groove connector positioned on the side portions adjacent to the front portion of the housing, said first and second halves of the tongue in groove connector adapted and configured to slidingly and the lid to the first and second side portions of the housing. The lid is slidingly movable by a closed position wherein the lid lies inclined over the open top with a portion of the adjacent the top edge resting on top of the back portion of the housing, and an open position wherein the lid is positioned away from the open top and adjacent the front portion of the housing.

With the foregoing in view, and other advantages as will become apparent to those skilled in the art to which this invention relates as this specification proceeds, the invention is herein described by reference to the accompanying drawings forming a part hereof, which includes a description of the preferred typical embodiment of the principles of the present invention.

DESCRIPTION OF THE DRAWINGS

In the drawings like characters of reference indicate corresponding parts in the different figures.

DETAILED DESCRIPTION OF THE INVENTION

Figure 1:
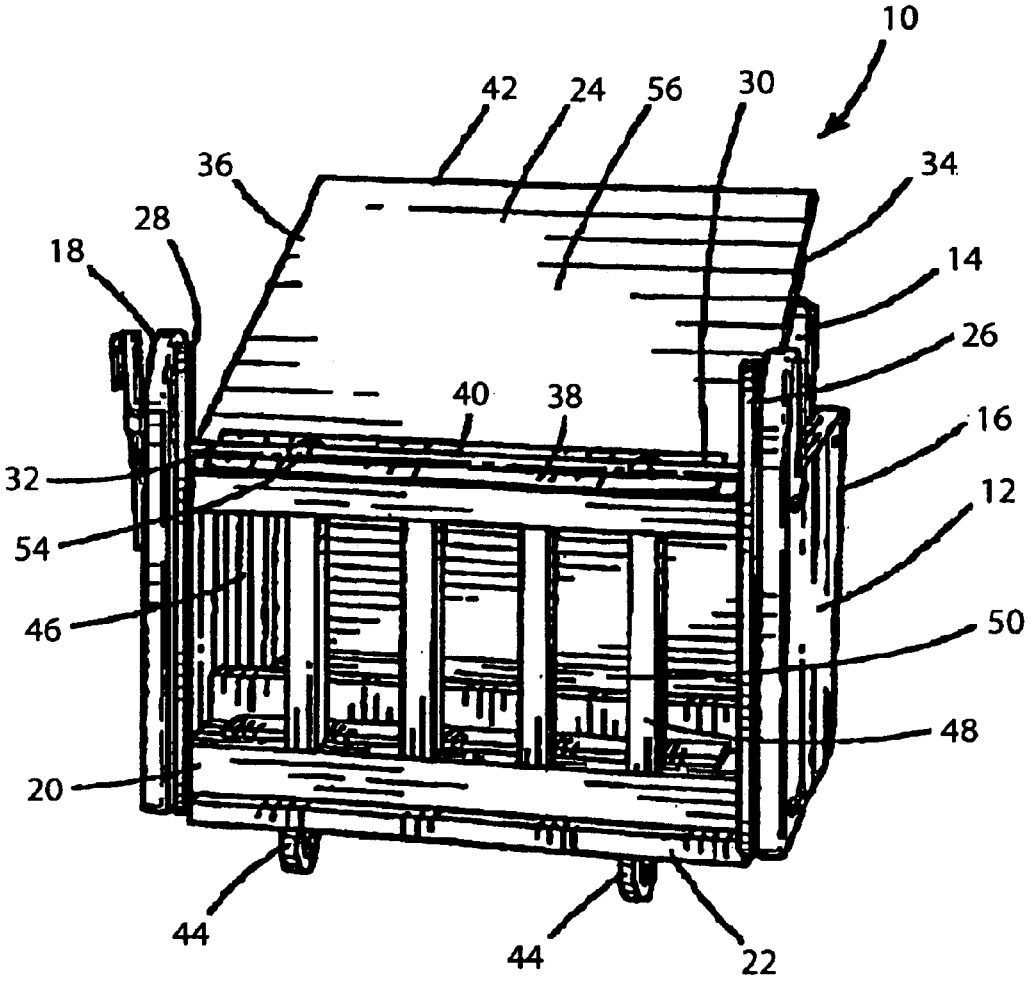
FIG. 1. Is a front perspective view showing the lid in its closed position.

Referring firstly to FIG. 1, a cart made in a accordance of the present invention as shown generally as item 10 and consists of a housing 12 having back portion 14 side portions 16 and 18 front portion 20, and bottom portion 22. Lid 24 is movably attached to side portions 16 and 18 via a tonge and groove connection elements 26 and 28. Tonge and groove connection elements 26 and 28 preferably consist of the groove half of the connection element. Connection elements 26 and 28 have an elongated groove which extend along the lengths of side portions 16 and 18 adjacent front portion 20. The grooves in connection elements 26 and 28 are configured to receive tonge and groove connection elements 30 and 32. Connection elements 30 and 32 are located towards side edges 34 and 36 of lid 24 towards bottom edge 38 of the lid. Preferably extensions 30 and 32 are formed from the opposite ends of elongated dowl 40 which is secured to lid 24 adjacent bottom edge 38. Lid 24 also had top edge 42 which is adapted and configured to be grasped by a user.

Bottom portion 22 is provided with castor wheels 44 which permit the entire unit to be wheeled about easily. Front portion 20 back portion 14, and side portions 16 and 18 all define an internal cavity 46 which is configured to receive magazines and books. In the specific embodiment shown in FIG. 1, front portion 20 consists of a grate like structure consisting of a plurality of struts 48 separated by gaps 50. This orientation of struts permit front portion 20 to retain objects within cavity 46 while permitting a user to view the contents of the unit. While not specifically shown in this embodiment, it should be appreciated that back portion 14 and side portion 16 and 18 may be constructed in a similar front to front portion 20.

Figure 2:
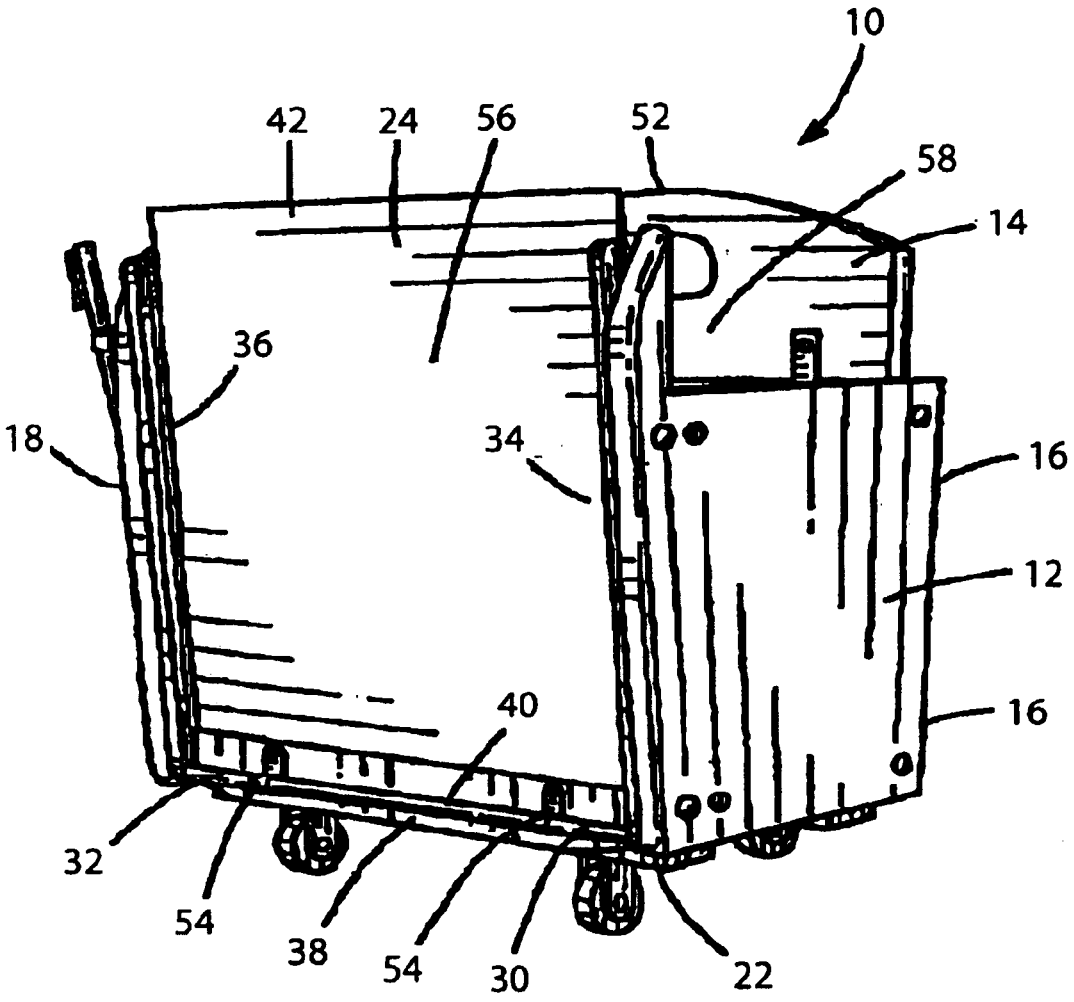
FIG. 2. Is a perspective view showing the lid in its open position.
Figure 3:
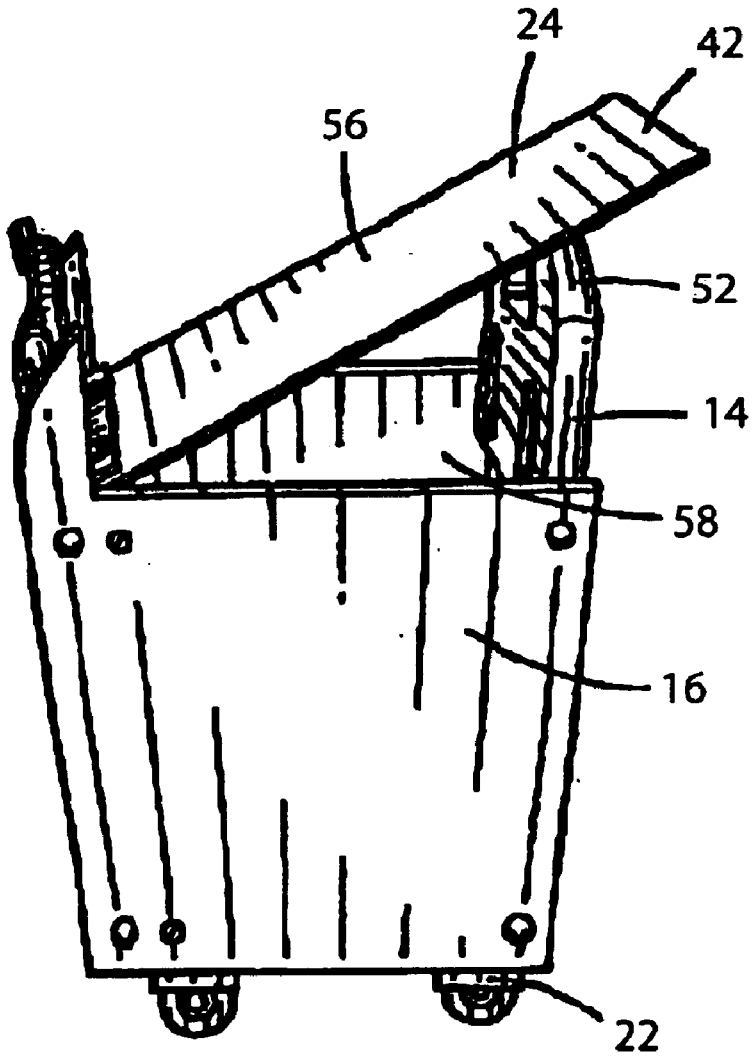
FIG. 3. Is a side perspective view showing the lid in its closed position.

Referring now to FIG. 2, back portion 14 has a top ridge 52 which is configured to support a portion of lid 24 adjacent top edge 42. As mentioned above, portions 14, 16, 18 and front portion 20 (see FIG. 1) define an internal cavity having an opening 58 configured to permit objects such as magazines to pass there through. Lid 24 is movably mounted to side portions 16 and 18 between an open position as shown in FIG. 2 wherein the lid is positioned away from opening 58 and is oriented substantially vertically, and a closed position as shown in FIG. 3 wherein lid 24 is inclined on top of back portion 14 and at least partially blocks off opening 58. With lid 24 in its closed position, the user may rest a magazine or other object on to top surface 56 to read the magazine. Lid 24 acts as a reading surface. Top surface 56 of lid 24 may be coated with a non slip material such as rubber to prevent the magazine from slipping off the top surface. Top ridge 52 of back portion 14 is dimensioned and configured such that it securely supports lid 24. The height of back portion 14 is selected such that lid 24 is at an acute angle when the lid is in its closed position. Preferably lid 24 should be on an angle of less than 45 degrees from the horizontal when the lid is in its closed position. It has bee discovered that if lid 24 is at an angle of less than 45 degrees from the horizontal, than the lid is much less likely to slid into its open position from its closed position when heavy objects are placed on top of surface 56.

Referring now back to FIG. 1, elongated dowl 40 is secured adjacent bottom edge 38 of lid 24, Dowl 40 is secured in place by connector elements 54. Dowl 40 act as a lower lip ensuring that any book or magazine which is resting on top surface 56 does not slide off of lid 24. It is possible that dowl 40 may be replaced by an elongated ridge or other structure which is milled into the surface of lid 24.

A specific embodiment of the present invention has been disclosed; however, several variations of the disclosed embodiment could be envisioned as within scope of this invention. It is to be understood that the present invention is not limited to the embodiments described above, but encompasses any and all embodiments within the scope of the following claims.

Therefore, what is claimed is:

1. A cart for storing and displaying items comprising:

a housing having a bottom, a front portion extending upward from the bottom, a back portion extending upward from the bottom portion, and opposite first and second side portions each extending upwardly from the bottom portion between the front and back portions to form a container configured to store objects, said container having on open top through which said objects may be deposited or retrieved, a lid dimensioned to substantially cover the open top of the container, the lid having a top edge and a bottom edge and opposite first and second side edges extending between the top and bottom edges, the lid having a first half of a tongue in groove connector positioned on each side edge adjacent the bottom edge, the first and second side portions of the housing each having a second half of the tongue in groove connector, the second halves of the tongue in groove connector positioned on the side portions adjacent to the front portion of the house said first and second halves of the tongue in groove connector adapted and configured to slidingly attach the lid to the first and second side portions of the housing, the lid being slidingly movable between a closed position wherein the lid is inclined over the open top with a portion of the lid adjacent the top edge resting on top of the back portion of the housing, and an open position wherein the lid is positioned away from the open top and adjacent the front portion of the housing.

2. A cart for storing and displaying items as defined in claim 1 wherein the first half of the tongue in groove connector courses a rod like extension projecting from the side edges of the lid, the rod like extensions positioned adjacent the bottom edge of the lid, and wherein the second half of the tongue in groove connector comprises an elongated groove, the groove dimensioned and configured to slidingly receive the rod like projection.

3. A cart for storing and displaying items as defined in claim 2 wherein the back portion of the housing is configured to position the lid at an acute angle when the lid is its closed position.

* * * * *